United States Patent [19]

Bory

[11] 3,942,299

[45] Mar. 9, 1976

[54] PACKAGING METHOD

[75] Inventor: Jacques Bory, Geneva, Switzerland

[73] Assignee: Gatrun Anstalt, Vaduz, Liechtenstein

[22] Filed: July 3, 1974

[21] Appl. No.: 485,557

[30] Foreign Application Priority Data

July 4, 1973 Switzerland ..... 9730/73

[52] U.S. Cl. ..... 53/21 R; 53/111 R; 53/167

[51] Int. Cl.[2] ..... B65B 55/06; B65B 55/14

[58] Field of Search ..... 53/21 R, 21 FC, 111 R, 53/167

[56] References Cited

UNITED STATES PATENTS

| | | | |
|---|---|---|---|
| 3,478,489 | 11/1969 | Meisner | 53/167 |
| 3,530,641 | 9/1970 | Bergstrom | 53/167 |
| 3,783,581 | 1/1974 | Pierce | 53/167 X |
| 3,820,300 | 6/1974 | Reinecke et al. | 53/167 X |

*Primary Examiner*—Travis S. McGehee

*Attorney, Agent, or Firm*—Bacon & Thomas

[57] ABSTRACT

A method and apparatus for packaging products such as foodstuffs in which containers are made by heat deforming a band of thermoplastic material in which the band is deformed, the containers are filled, and a metallic cover coated with a thermoplastic material is secured to the filled container in a pressurised environment for example, in the presence of superheated dried steam. The containers are cooled in a connected chamber prior to leaving a housing in which the environment is produced and cutting of the containers from the band and one another.

9 Claims, 5 Drawing Figures

PACKAGING METHOD

The present invention relates to a method and apparatus for packaging.

According to a known method of this type, one forms initially the containers by heat deformation of a plastics material band, one fills the said containers with a product to be packaged, one then closes the containers with the aid of covers sealed on the edges of the containers and obtained starting from a metallic sealing band covered with a thermoplastic material and finally one cuts from the two superposed bands the filled sealed containers.

A known packaging installation for effecting the above mentioned method comprises in series a station for stocking and feeding the plastics material band, a step by step transport mechanism for the thermo-plastic band through the installation, a heating station receiving the thermo-plastic band in an unrolled state, a forming station for forming the containers from the thermo-plastic bag, a filling station for introducing the products to be packaged into the containers formed, a container closing station to hermetically close the said containers with the aid of a metallic sealing band covered with a thermoplastic material and sealed on the edge of the containers, a cutting station for separating the filled and sealed containers, from, on the one hand, both the plastic and metallic band, and, on the other hand, the adjacent containers, and then a discharge station for transporting the cut containers individually or in groups towards a collector or stocking station.

This packaging method and installation do not permit the packaging with the aid of thermoplastic containers of products under pressure or giving rise to the formation of an internal pressure when, once it has been hermetically sealed, they are subjected to a heat treatment, for example with a view to sterilisation.

According to the present invention there is provided a method of packaging, said method comprising constructing containers by heat deforming a plastics material band, filling the said containers with a product to be packaged, feeding a sealing metallic band covered with a thermoplastic material, closing the containers with a sealed cover on the edges of the container formed from said band, cutting the band the filled and sealed containers, at least the filling and the closing of the containers being effected in an environment under pressure, of which the pressure is above atmospheric pressure and is at least of a value such that one may avoid all boiling of the product at the filling temperature of the product.

In this manner, it is possible to maintain the products, for example pre-sterilized at their pre-sterilization pressure and to avoid splashing of the product at the moment of its introduction into the containers. The suppression of the splashing guarantees the correct edges of the container and due to this fact, one closes perfectly hermetically the containers.

This new method of packaging lends itself also to the sterilization of the products at the moment of their introduction into the containers.

According to another feature of the invention, one effects the filling of the containers with the product to be packaged in the fixed environment of sterilization of which the temperature is equal to or greater than the temperature of sterilization and of which the pressure is sufficient to avoid, at the temperature of the environment, boiling of the product, one maintains the containers full in the sterilization environment during a lapse of time sufficient for the sterilization of the product and the containers, one effects the closing of the filled containers in the sterilization environment. To avoid exploding of the closed containers and containing a presterilized or a sterilized product, at the moment where the containers are returned to an ambient environment at a normal pressure and temperature, one passes the closed containers in a fixed cooling environment, of which the pressure is substantially equal to that of the environment of overpressure or of sterilization, but of which the temperature is clearly lower than that of the said sterilization environment.

In order to sterilize the containers before their filling and the sealing band before its application on the containers, it is advantageous to let the said containers and the said band remain in the said sterilization environment for a sufficient time before the filling and closing of the said containers.

In order to avoid all pollution of the containers between their forming and their closing, one carries out the forming of the containers in the sterilization environment.

For practical reason of introduction of the thermoplastic band into the overpressure or sterilization environment and to reduce the loss of pressure to a minimum, one effects the heating of thermoplastic band in the overpressure or sterilization environment.

With the view to avoid a large overpressure in the hermetically sealed containers, overpressure causing a bulging of the cover of the containers, one utilized in the zone of the overpressure environment, a zone associated with filling and closing of the recipient, of superheated dry steam.

The invention also provides an installation for forming and filling containers, comprising a fluidtight housing, means for connecting said housing to a source of gaseous fluid pressure, step-by-step transport means extending into and out of said housing, an entry airlock at the upstream end of said housing and an outlet airlock located at the downstream end of said housing, said transport means passing through said airlocks, a stocking and feeding station for a thermoplastic material band, a heating station for receiving the thermoplastic band in an unrolled state, a forming station for making containers from the thermoplastic band, a filling station to introduce the products to be packaged into the containers formed, means for feeding a metallic sealing band provided with a thermoplastic film, a closure station for the container, to close hermetically the said containers with said band on the edges of the containers, a cutting station to separate the filled and sealed containers from the assembled thermoplastic and metallic bands and from the neighbouring containers, and a discharge station to transport the cut containers individually or in groups towards a collecting station, at least the filling station and the closure station being located in said housing.

It is advantageous to provide the entry airlock upstream of the heating station and for the housing to extend upstream of the heating station. With this arrangement, it is sufficient to provide on the front cover of the said housing an entry slot of which the dimensions correspond to those of the thermoplastic band and to mount on the interior face of the said front cover on each side of the slot, a lipseal of which the lips are directed towards the heating station.

In the zone of overpressure, the housing may comprise at its upper part, between the filling station and the closing station an airlock for the sealing band.

In order to provide for cooling under pressure of the products being subjected, before or after their introduction into the containers, a heat-treatment such as a sterilization treatment, one can extend the sealed housing as far as the closing station up to the outlet airlock.

The housing may be of round transverse sections inscribed in a rectangle, preferably equilateral and of which the curved lateral faces which are tangential to the sides of the rectangle, of a radius of curvature which is much greater than at the parts of the section which are situated at the angles of the rectangle which join progressively the curved lateral faces.

According to a feature of the invention, the sealed housing is subdivided into several sections of which a first is associated with the heating station, of which the second is associated with the filling and closing stations and of which a third is associated with the cooling zone situated between the closing station and the outlet airlock, each section of the housing being provided with a closable conduit going towards a source of pressure having a temperature measuring device and a calibrated overpressure valve.

The forming and sealing stations and a part of the outlet airlock rest on the ground by means of pillars and serve to support the sections of the housing which, by their end flanges are fixed in a fluid type manner to the forming and receiving stations and to the outlet airlock. The step-by-step transport mechanism for the thermoplastic band and the containers fixed on the band comprise two endless chain conveyors provided with grippers to seize each band on its edges, conveyors which are disposed one behind the other, the one at the interior of the fluidtight housing between the entry airlock and the outlet airlock and the other downstream of the said outlet airlock and which are driven in synchronism.

Preferably the stepwise advance of the containers disposed downstream of the outlet airlock is slightly greater than that of the conveyor disposed in the housing.

The section of the housing associated with the cooling zone may include on its exterior face, cooling vanes.

At the interior of the section of the housing associated with the cooling zone, may be provided a cooling tank disposed below the level of the thermoplastic band, vertically movable and actuated by a jack disposed below the said bath and of which the movement is at least equal to the height of the containers and of which the actuation takes place immediately before and after each advance step of the thermoplastic band, the cooling bath being provided with a liquid refrigerant circuit.

In order to reduce the heat exchange between the cooling zone and the overpressure zone associated with the filling and closing stations, this can be provided between each of these two zones, a heat barrier constituted by two screens having supple lips which are mounted in the same vertical plane on the downstream frontal face of the closure station and are disposed with respect to one another in such a manner to leave a passage for the containers while resting applied by the lips on at least the cover and the bottom of the said containers.

In order to reduce the heat exchange between the heating zone for the thermoplastic band and the overpressure zone associated with the filling and closing stations, a thermal barrier constituted by two screens having supple lips is mounted on the frontal vertical face of the forming station, such that the two lips are applied one on each face of the thermoplastic band.

The outlet airlock comprises two valve of which the one if fixed and of which the other is movable parallel to the plane of movement of the thermoplastic band and of the containers and is associated with a control jack.

The fixed door of the outlet airlock may comprise, a separation partition fixed laterally in a fluidtight manner on a section of the housing, preferably on that one associated with the zone of cooling, and provided with a passage opening for the thermoplastic band and the containers, and two vertical closure valve which are disposed one above the other and on each side of a horizontal plane determined by the thermoplastic band which are applied by one of their lateral faces under the effect of pressure existing in the overpressure zone or the cooling zone, and which are acting in a fashion to provide alternately opening and closing of the passage opening of the separation partition, at least the lower valve being movable in a plane parallel to that of the partition and having a thickness lower than the separating thickness of the closest parts of two adjacent containers in the sense of movement of the said containers.

The movable door of the outlet airlock comprises a piston support of a part located in an immovable and fluidtight manner in another section of the housing of which one end is mounted in a fluidtight manner on the downstream lateral face of the separation partition and, on the other hand, provided with a cylindrical bore of which the generatrices are parallel to the horizontal plane determined by the thermoplastic band, an extraction piston which is guided in a fluidtight manner in the cylindrical bore by the piston support, the piston being connected to the movable member of a control jack of which the fixed member is connected to the said piston support, which comprises moreover a pierced passage aligned with the passage opening of the said partition such that two vertical closure valves which are mounted on the extraction piston on each side of a horizontal plane determined by the thermoplastic band, act in a fashion to enable alternate freeing and closing of the pierced passage, and of which at least the lower valve is movable, is guided in a fluidtight manner in a vertical slot of the extraction piston, and is of a thickness less than the thickness separating the closest parts of two adjacent containers measured in the direction of movement of the said containers.

The movable valves of the two doors of the outlet airlock are each associated with a control jack, the jack associated with the movable valve of the extraction piston being fixed to the latter.

The path of movement of the control jack of the extraction piston synchronized with the step-by-step advance movement of the thermoplastic band and is equal, or slightly greater, than the advance step of the conveyor located in the overpressure housing.

In order to reduce the volume of the chamber, the chamber delimited by the two doors of the outlet airlock and the part of the housing supporting the two doors, the minimal spacing between the valves of the two doors is equal to the thickness of a container, measured in the sense of advance of the thermoplastic band, that is to say the length of an advance step of the conveyor located in the overpressure housing.

The chamber of the outlet airlock is capable of being connected to a source of fluid under pressure.

In order to enable adaptation to a number of different advance movements of the thermoplastic band the length of the sections of the housing between two adjacent fixed stations such as the forming station, the closure station, the fixed door and the piston support of the outlet airlock, and the cutting station, one provides at least one adjustment ring between the flange of a section of the housing and the neighbouring lateral face of a corresponding station.

The invention will be better understood from the following description, given by way of example, reference being made to the accompanying drawings in which.

Figure 1:
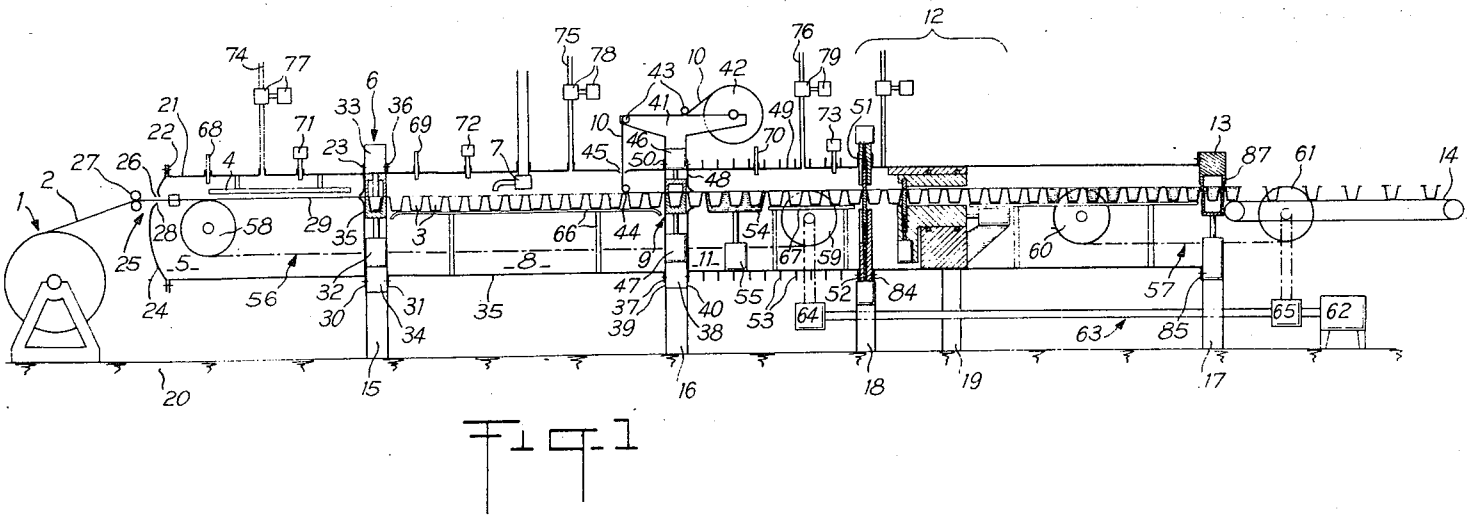
FIG. 1 is a vertical longitudinal section through a packaging installation according to the invention.
Figure 2:
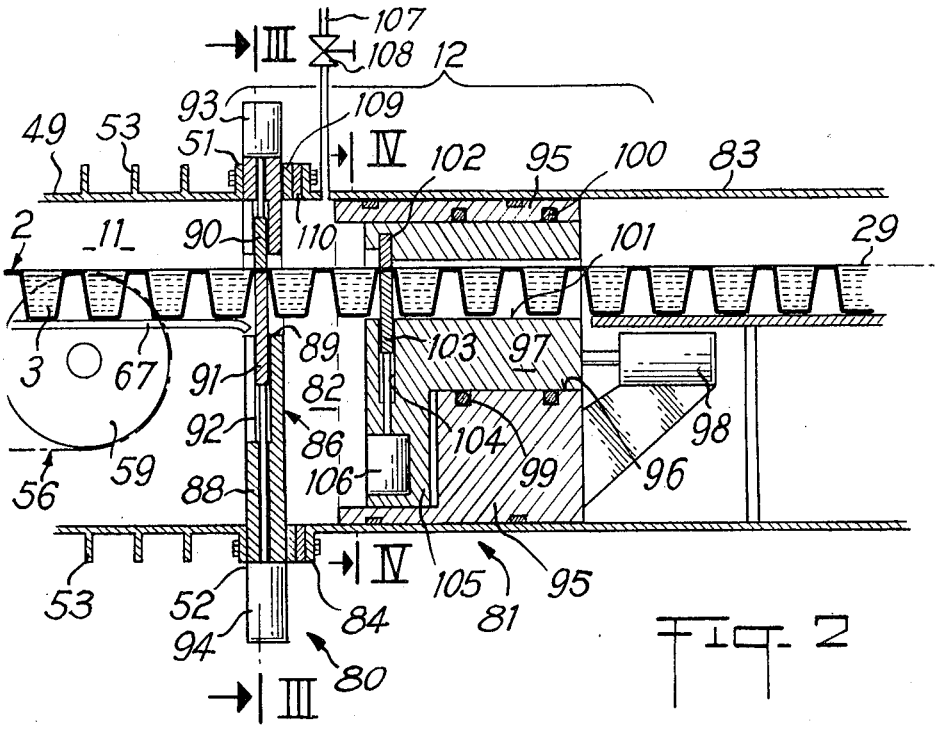
FIG. 2 is a vertical longitudinal enlarged section through an outlet airlock of the installation.
Figure 3:
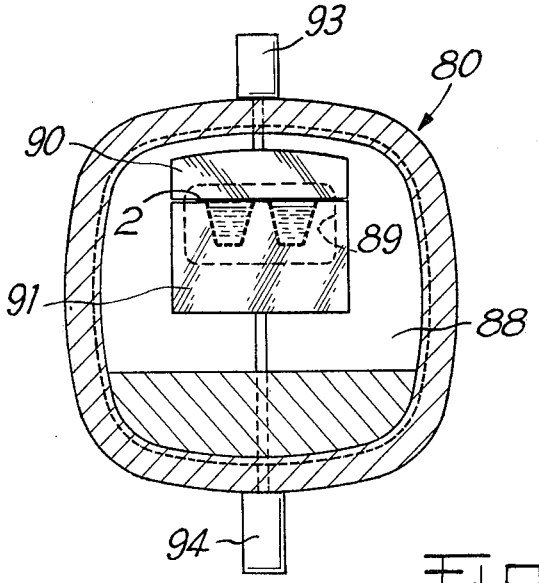
FIG. 3 is a vertical transverse section through a fixed door of the outlet airlock taken along the line III—III of FIG. 2.
Figure 4:
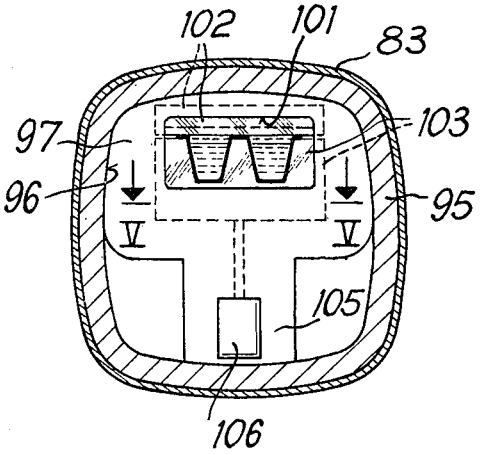
FIG. 4 is a vertical partial transverse section through the movable door of the outlet airlock taken along the line IV—IV of FIG. 2.
Figure 5:
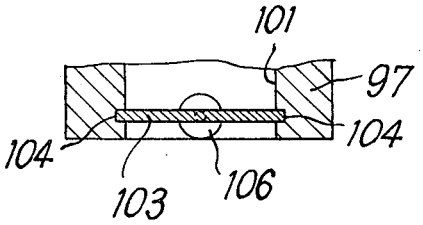
FIG. 5 is a horizontal section through the movable valve of the movable door taken along the line V—V of FIG. 4.

As is represented schematically in FIG. 1, the packaging installation comprises in series firstly a stocking and feeding station 1 of a thermoplastic material band 2 and in which are formed the containers 3, a heating station 4, provided in a fluidtight heating housing 5, a forming station 6, a filling station 7 serving to introduce under pressure a liquid paste or granular or powder product into the containers 3 and disposed in a fluidtight chamber 8 under pressure, a closure or sealing station 9 equally provided in the chamber under pressure 8 and serving to close hermetically the containers 3 with the aid of a cover formed starting from a metallic sealing band 10 provided on one face with a thermoplastic material, a cooling chamber 11, an outlet airlock 12, a cutting station 13 serving to cut from the two welded and assembled bands 2 and 10 the filled and closed containers 3, as well as an evacuation post 14 to transport the cut containers individually or in groups towards a stocking or discharging station (not shown).

The forming, closure or sealing and cutting stations 6, 9 and 13 are in themselves known, with the exception that they have annular vertical plane faces, and there is no need for them to be described in further detail. One should however remark that they are supported by vertical posts 15, 16 and 17 which together with those (18, 19,) of the outlet airlock 12, are the only mountings of the installation on the floor of the factory. A frame (not shown) of the installation is fixed on the posts 15 to 19.

The housing of the heating chamber 5 is defined by a cylindrical tubular section 21 provided with two end flanges 22, 23, of which one (22) situated on the side of the stocking station 1 is closed in a fluidtight manner by a tied frontal cover 24 providing an entry or access airlock 25 for the thermoplastic band 2. The entry airlock 25 is constituted by a horizontal entry slot 25 of which the dimensions are adapted to those of the band 2 which is guided upstream of the said slot via a pair of transport rollers 27 of which the generatrix of contact is perpendicular to the edges of the said band 2 and situated in the same horizontal plane as the slot 26. The entry or access airlock 25 equally comprises on an interior face of the cover 24, on one side and the other of the slot 26, a lip seal 28 of which the lips converge in a direction of the heating post towards the horizontal plane passing through the slot. The horizontal plane constitutes moreover the plane of transport or advancement 29 of the band 2 to the packaging installation.

The other end flange 23 of the housing section 21 is fixed in a fluidtight manner on one of two annular plane faces 30, 31 of a forming post 6 of which the control jacks 32, 33 form part of the endless support 34 of the said station 6. A heat barrier 35 formed by two screens having supple lips touching the thermoplastic band 2 and converging towards the front cover 24 cover the opening left between the annular support 34 and is fixed on the frontal face 30 of the support, the face turned towards the heating chamber 5.

The housing of the overpressure chamber 8 is defined by the forming post 6, a closure or sealing post 9 and by a section of a cylindrical tube section 35 provided with end flanges 36, 37. The sealing section 9 comprises as the forming post 6, an endless support 38 resting on posts 16 and having two annular plane frontal faces 39, 40. 1, 36, of the end flanges of the cylindrical tube section 35 is fixed in a fluidtight manner on the frontal annular face 31 of the annular support 34 of the forming station 6 and the other flange 37 is fixed in a fluidtight manner on the annular frontal face 39 of the closure station 9. On the annular support 38 is mounted, to the exterior of the cylindrical tube section 35, a support 41 for a roller 42 of the metallic sealing band 10 which, on the face destined to be applied on the horizontal edges of the containers 3, is constituted by horizontal parts which are not deformed of the thermoplastic band 2 these having a thermoplastic film. The sealing band 10 is guided by several guide rollers 43, 44 and passes into the overpressure chamber 8 through an entry airlock 45 provided in the upper part of the tube section 35 and constituted, as in the case 25, by a slot and a lip seal disposed on one side and the other of the slot for the band 10 on the interior face of the tube section 35. The closure station 9 comprises two control jacks 46, 47 for the sealing tools, the jacks being provided at the interior of the periphery of the annular support 39 which is, mounted on the support posts 16. On the downstream frontal face 40, the annular support 38 of the closure station 9 is provided with a heat barrier 48 constituted by screens having supple lips which are disposed one above the other in a fashion to leave a passage for the sealed containers and resting applied, by their lips, at least on the covers and the bottoms of the containers.

The cooling chamber 11 is delimited by the sealing station 9, the upstream extremity of the outlet airlock and by the cylindrical tube section 49 of which the end flanges 50, 51 are fixed in a fluidtight manner, on one hand on the frontal downstream face 40 of the sealing station 9 and on the other hand by the frontal upstream face 52 of the outlet airlock 12. The section 49 of the housing surrounding the cooling chamber 11 is, for example, provided on its exterior face with cooling vanes 53. In use of the installation the cooling bath 54 having a liquid refrigerant circuit not shown, is disposed below the plane 29 of the thermoplastic band 2, and is vertically movably mounted under the effect of a control jack 55 provided in the cooling chamber 11. The depth of the bath 54 is slightly greater than the height of the containers 3 and its length taken in the direction of advance of the containers is equally more than an advance step, for example three advance steps. The path of movement of the jack 55 is greater than the height of the containers such that in its lower position of the bath 54, the containers 3 can advance without being hindered by the latter. After each advance step, the bath is lifted and comes into its raised position where the containers 3 are plunged into the liquid refrigerant and preferably the edge of the bath 54 supports the containers 3 by their edges constituted by the flat parts which are not deformed of a thermoplastic band 2, and separated in certain instances by two neighbouring containers.

The thermoplastic band 2 is displaced step-by-step in the packaging installation by means of a transport mechanism which comprises in series two endless chain conveyors 56, 57. Each conveyor 56, 57 comprises two pairs of toothed feed rollers 58, 59 and 60, 61, and two endless lateral chains 62 and 63. The endless chains 62, 63 are provided with grippers, not shown, and capable of sealing and gripping the edges of the thermoplastic band 2 on the upper run of the chains, along a path which coincides substantially with the horizontal plane 29 determined by the band 2. The first conveyor 56 is disposed between the two airlocks 25 and 12 and is therefore entirely located in the fluidtight housing. The second container 57 is provided downstream of the outlet airlock 12 and is located in the free air. The downstream pairs of rollers 59 and 61 of conveyor 56, 57 are driven in synchronism by a common motor 62 by means of a transmission 63 comprising for each pair of downstream rollers 59, 61, a speed variator 64 and 65 and acting at the exterior of the chamber on the shafts of the said rollers. In order that the thermoplastic band 2 should always be slightly tensioned one regulates the speed variator 65, associated with the second conveyor 57 such that its advance steps are slightly greater than those of the first conveyor 56. In order that the containers, above all when they are filled, should not be without support for too great a distance, one provides also in the overpressure chamber 8 as well as the cooling chamber 11 support slide rails 66, 67 on which can rest and slide the bottoms of the said containers 3. In order to control at will the temperature and pressure existing in the different chambers 5, 8 and 11, each of these chambers, which are in principle at the same pressure of a value greater than that of atmosphere, it is provided with a control thermometer 68, 69, 70, a safety valve 71, 72, 73 against excessive overpressure and a feed conduit 74, 75, 76 each having a closure 77, 78, 79 and connected to a gaseous source of fluid under pressure (not shown). Just as the heating chamber 5 and the overpressure chamber 8 are, in general, connected to a source of heated fluid under pressure, the cooling chamber 11 is connected to a source of cold gaseous fluid under pressure.

The outlet airlock 12 shown in detail in FIGS. 2 to 5, comprises between 2 doors 80 and 31, an airlock chamber 82 delimited moreover by a cylindrical tube section 83 of which the two end flanges 84, 85 are fixed on the one hand in a fluidtight manner on the downstream frontal face 36 of the upstream door 80 and on the other hand on the upstream frontal face 87 of the cutting station 13. The upstream door 80 is at a fixed position and comprises a separation partition 88 which by the peripheral part of its two frontal faces 52 and 86 is mounted in a fluidtight manner between the downstream flange 51 of section 49 and the upstream flange 84 of tubular section 83. At the level of the containers, the partition 88 is provided with a passage aperture 89 for the thermoplastic band 2 and the containers 3 which are attached thereto for example in sets of 4, 6, 8 or even 12. The upstream door 80 equally comprises two closure valves 90, 91 superposed parallel to the partition 88 and applied in a fluidtight fashion against the upstream frontal face of the latter under the effect of the pressure existing in the cooling chamber 11. The closure valve 90, 91, laterally guided in vertical lateral guide grooves 92 of the partition 88, are disposed on each side of the plane 29 determined by the thermoplastic band 2 and act in a manner alternately to free and close the opening of the passage 89 of the partitions 88 in separating or approaching one another, parallel to the plane of the partition, the said plane 29 existing in the form of the non-deformed parts of the band 2 which are left between the neighbouring containers 3. The two closure valves 90, 91 are vertically movable under the action of jacks 93, 94 acting simultaneously in the opposite senses, but the upper valve 90 can alternatively be fixed. When the two valves 90, 91 press between them and the non-deformed plane parts of the band 2, existing between the two transverse groups of containers 3, a sufficient fluidtightness is assured between the cooling chamber 11 and the airlock chamber 82. The thickness of the lower valve 91 at least is less than the spacing between two adjacent transverse groups of containers 3.

The movable door 81 of the outlet airlock 12 comprises a piston support 95 which is located in a fluidtight manner on its periphery in the housing section 83 and which is provided by a cylindrical bore 96 of which the generatrices are parallel to the horizontal plane 29 determined by the thermoplastic band 2. In this bore 96 is mounted, in a movable and fluidtight fashion, an extraction piston 97 which is capable of being displaced alternately in the same sense and in the opposite sense to the thermoplastic band 2 under the effect of a control jack 98 of which the movable member is connected to the said piston 97 and of which the fixed member is for example fixed to the piston support 95. The fluidtightness between the extraction piston 97 and the cylindrical bore 96 is assured by sealing gaskets 99, 100 fixed, either to the support 95 or to the piston 97. The extraction piston 97 comprises moreover a pierced passage 101 of which section is identical to that of the passage opening 89 of the partition 88 and which is horizontally aligned with the said opening 89. On the extraction piston 97, for example, close to its upstream face, are provided on each side of the horizontal plane 26 and perpendicular to the direction of advance of the thermoplastic band 2, two closure valves 102, 103 of which at least the lower valve 103 is movable and guided in a fluidtight fashion in a vertical slot 104 formed in the lower part and in a lower protuberance 105 of the extraction piston 97. The lower valve 103 has a vertical path at least slightly higher than the containers 3 and it is movable by a control jack 106 located in a lower protuberance 105 of the piston 97. The upper valve 102 is fixed and extends, by its lower extremity up to the level of the horizontal plane 29. The thickness of the lower valve 103 is at least slightly less than the spacing between two transverse neighbouring sets of containers 3. When the lower valve 103 is operated by the jack 106 against the plane non-deformed part of the band 2, and the said part against the lower extremity of the upper valve 102, the movable door 81 of the outlet airlock 12 closes hermetically the chamber of the airlock 82 with respect to the exterior. The chamber 82 can be fed from a source of compressed gaseous fluid, preferably cooled, by means of a conduit 107 provided with a closure valve 108.

To be able to adapt the length of the chambers 8 and 11 between two fixed stations, for example between the forming station 6 and the sealing section 9 or between the latter and the upstream door 80 of the outlet airlock 12 or between the latter and the cutting station 13, there is provided one or more adjustment rings 109, 110 between the flange, for example 84 of the tube section 83 and the neighbouring frontal face 86 for example of the corresponding station, for example the door 80.

The method of packaging capable of being put into effect with the aid of the above described installation will readily be understood. Due to the fact that one produces in a chamber, notably the overpressure chamber 8, a superior pressure to that of the atmosphere and sufficient to avoid a product arriving from the station 7, under a certain internal pressure, would decompose partially or be boiled at the temperature existing in the chamber 8 and that one maintains this overpressure in the said chamber up until near the fluidtight closing of the containers 3 filled under the station 7, one can utilize plastics materials for the packaging of products under pressure. When the product arrives in the chamber 8, it can already be at a temperature corresponding to the temperature of sterilization for the pressure at which it is subjected in the filling station 7 and in the chamber 8, but can equally carry the product at its temperature of sterilization after having been introduced into the containers 3 in the chamber 8 where one maintains the overpressure which, for the temperature of sterilization, considered and mainly less than the softening temperature of the thermoplastic material for the fabrication of the containers 3, one avoids boiling or partial evaporation of the product. It is to be remarked that the cooling chamber 11 need only be used when the product contained in the containers 3 is to be cooled rapidly. Otherwise, this chamber 11 can be omitted and the outlet airlock 12 is connected directly to the sealing station 9.

The two doors 80 and 81 of the outlet airlock 12 are opened and closed alternately. Moreover, the extraction piston 97 withdraws for example from an advanced step in the direction of the fixed door 80 when the valves 102, 103 are in an open and advanced position in synchronism with the band 3 after the fluidtight closure of the said valves. In order not to disturb the pressure existing in the neighbouring chamber, for example the cooling chamber 11, one can after each bringing to atmosphere of the airlock chamber 82 and its closure, establish the overpressure in the said chamber with the aid of the conduit 107. If one desired to introduce periodically a cold fluid under pressure into the cooling chamber 11, one can feed the airlock chamber 82 by letting escape a part of the fluid between reheating times and in order to permit a new feed of the chamber 11 with a cold fluid without increasing the value of the predetermined overpressure.

The packaging method of the products in the plastics material packages according to the invention, is distinguished by the fact that the feeding and/or the heat treatment of the products in the containers of plastics material is effected in an overpressure housing 8 as the containers are advanced step-by-step.

It can be applied notably to the manufacture of preserved foodstuff where for example the products to be preserved are predviously sterilized at a temperature above 100°C, and then conveyed at a temperature above 100°C in the chamber 8 where there exists the pressure above that of atmospheric pressure and sufficient to avoid boiling of the product. In this chamber 8 is to be found the feed system 7 which distributes the products to be preserved in the plastics material containers previously formed in the chamber 8. After filling which is effected under pressure, a jet of dry steam can be utilized to purge the air contained in the upper part of the containers 3 which remains empty, then the containers 3 are sealed in a fluidtight manner by heat sealing a sealing band 10 on their opening.

These filled and sealed containers are then sterilized in the chamber 8, then cooled in the chamber 11 of which the pressure is also at the overpressure of the chamber 8. During the cooling, the dry steam contained in the containers 3 is condensed and forms a space in the container 3 or reduces at least considerably the initial overpressure.

In a modification, more particularly intended for continuously packaging products which cannot be presterilized or dosed continuously, the forming and filling of the containers 3 is effected in a non-sterile fashion, then the filled but not yet sealed containers are placed in the chamber 8 under overpressure as previously where it is sterilized, before or after their closure, then cooled in the cooling chamber 11.

This method permits not only the packaging of preserved foodstuffs in plastic packages, but equally that packaging in plastic packages of products which are to be fed under pressure and not necessarily having a heat treatment as is the case for example for beer.

It is obvious, that the embodiment previously described can be subjected to numerous modifications without going beyond the scope of the invention.

I claim:

1. A method of packaging products comprising the steps of:

establishing and maintaining an environment of substantial superatmospheric pressure;

forming connected containers by heating and deforming successive portions of a plastic band;

directing said connected containers through said environment;

feeding a product, under pressure at least equal to that of said environment into said containers in said environment;

feeding a band of metallic cover material, coated with a thermoplastic into said environment in covering relation to said containers and sealing the same thereto;

heating said product to its sterilization temperature while maintaining said pressure at a value to prevent boiling of said product and holding said product at said temperature and pressure for a sufficient time to effect complete sterilization; and removing said sealed containers from said environment to an ambient environment and severing said containers from said bands.

2. The method of claim 1 including the further step of cooling said sealed containers after said sterilization while maintaining said superatmospheric pressure thereon.

3. The method of claim 1 wherein said heated and formed containers are held in said environment for a time sufficient to sterilize the same before said feeding step.

4. The method of claim 1 wherein said container forming step is performed in said environment.

5. The method of claim 1 wherein the step of heating said plastic band is performed in said environment.

6. The method of claim 1 wherein the atmosphere in said environment comprises superheated steam.

7. The method of claim 1 wherein the step of heating said product to its sterilization temperature is performed before feeding said product into said containers.

8. The method of claim 1 wherein the step of heating said product to its sterilization temperature is performed after the feeding of said products into said containers, but before said sealing of said cover material to said containers.

9. The method of claim 1 wherein the step of heating said product to its sterilization temperature is performed after the feeding of said product into said containers and said sealing of said cover material to said containers.

* * * * *